US011981489B2

(12) United States Patent
Gungner

(10) Patent No.: US 11,981,489 B2
(45) Date of Patent: May 14, 2024

(54) CARRIER WITH CONTAINER RETENTION FEATURES

(71) Applicant: Graphic Packaging International, LLC, Atlanta, GA (US)

(72) Inventor: Greg Gungner, Cobourg (CA)

(73) Assignee: Graphic Packaging International, LLC, Atlanta, GA (US)

( * ) Notice: Subject to any disclaimer, the term of this patent is extended or adjusted under 35 U.S.C. 154(b) by 111 days.

(21) Appl. No.: 17/330,976

(22) Filed: May 26, 2021

(65) Prior Publication Data

US 2021/0371178 A1 Dec. 2, 2021

Related U.S. Application Data

(60) Provisional application No. 63/031,764, filed on May 29, 2020.

(51) Int. Cl.
*B65D 71/58* (2006.01)
*B65D 5/30* (2006.01)
(Continued)

(52) U.S. Cl.
CPC ..... *B65D 71/0022* (2013.01); *B65D 5/302* (2013.01); *B65D 5/4608* (2013.01); *B65D 5/48002* (2013.01); *B65D 5/5002* (2013.01)

(58) Field of Classification Search
CPC ..... B65D 71/0066; B65D 71/0062; B65D 71/004; B65D 71/0037; B65D 71/0014; B65D 71/0003; B65D 5/48006; B65D 5/48; B65D 71/0022; B65D 5/302; B65D 5/4608; B65D 5/48002; B65D 5/5002; B65D 2571/00141; B65D 2571/00253; B65D 2571/0037; B65D 2571/00487;
(Continued)

(56) References Cited

U.S. PATENT DOCUMENTS 1,968,877 A 8/1934 Cubberley
2,225,822 A 12/1940 Crook
(Continued)

FOREIGN PATENT DOCUMENTS

AR 78777 12/2008
CA 2 216 515 8/1997
(Continued)

OTHER PUBLICATIONS

International Search Report and Written Opinion for PCT/US2021/034224 dated Sep. 16, 2021.

*Primary Examiner* — Anthony D Stashick
*Assistant Examiner* — Marcos Javier Rodriguez Molina
(74) *Attorney, Agent, or Firm* — Womble Bond Dickinson (US) LLP

(57) ABSTRACT

A carrier for holding at least one container includes a plurality of panels extending at least partially around an interior of the carrier, the plurality of panels including a front panel, a back panel, at least one side panel, and at least one handle panel extending between the front panel and the back panel. The carrier further includes container retaining features for stabilizing the at least one container in the interior of the carrier, the container retaining features includes at least one container retention cut formed in an upper portion of at least one of the front panel and the back panel.

42 Claims, 5 Drawing Sheets

(51) Int. Cl.

| | |
|---|---|
| ***B65D 5/468*** | (2006.01) |
| ***B65D 5/48*** | (2006.01) |
| ***B65D 5/50*** | (2006.01) |
| ***B65D 71/56*** | (2006.01) |

(58) Field of Classification Search

CPC .. B65D 2571/0066; B65D 2571/00728; B65D 2571/00833; B65D 5/0066

USPC ..... 206/139, 750, 156, 147, 75

See application file for complete search history.

(56) References Cited

U.S. PATENT DOCUMENTS 2,227,330 A 12/1940 Turner
2,296,937 A 9/1942 Lyons, Jr.
2,298,191 A * 10/1942 Boh ..... B65D 71/0037 206/196
2,324,771 A 7/1943 Fiore
2,331,312 A 10/1943 Dorfman
2,336,857 A 12/1943 Gies et al.
2,345,567 A 4/1944 Arneson
2,371,471 A 3/1945 Rothstein
2,384,480 A 9/1945 Lupton
2,389,318 A 11/1945 Lebold
2,417,421 A 3/1947 Koolnis
2,446,161 A 7/1948 Price
2,522,950 A 9/1950 Keith
2,558,618 A 6/1951 Lebold
2,563,065 A * 8/1951 Price ..... B65D 71/0055 206/175
2,606,711 A 8/1952 Forrer
2,653,749 A 9/1953 Milchin
2,689,061 A 9/1954 Gray
2,783,916 A 3/1957 Hodapp
2,794,571 A 6/1957 Fielding
2,804,234 A 8/1957 Lachance
2,808,177 A 10/1957 Buttery
2,860,771 A 11/1958 Spiegel, Jr.
2,950,854 A 8/1960 Ganz
3,053,411 A 9/1962 Struble et al.
3,190,487 A 6/1965 Wood
3,191,800 A 6/1965 Kowal
3,229,849 A 1/1966 Spillson
3,236,414 A 2/1966 Slevin, Jr.
3,355,012 A 11/1967 Weiss
3,386,570 A 6/1968 Lock
3,394,800 A 7/1968 Brackett
3,669,306 A 6/1972 Forrer
3,670,950 A 6/1972 Rossi
3,744,704 A 7/1973 Struble
3,820,657 A 6/1974 Klygis et al.
3,884,353 A 5/1975 Forte
3,917,061 A 11/1975 Stout
4,101,069 A 7/1978 Wood
4,146,168 A 3/1979 Hartline
4,155,502 A 5/1979 Forte
4,171,046 A 10/1979 Bonczyk
4,205,748 A 6/1980 Wilson
4,234,114 A 11/1980 Wood
4,243,138 A 1/1981 Wilson
4,284,195 A 8/1981 Champlin
4,308,950 A 1/1982 Wood
4,312,446 A * 1/1982 Summers ..... B65D 71/0014 206/185
4,326,628 A 4/1982 Wood
4,362,240 A 12/1982 Elward
4,374,561 A 2/1983 Stout et al.
4,413,729 A 11/1983 Wood
4,424,901 A 1/1984 Lanier
4,450,956 A 5/1984 Wood
4,480,746 A 11/1984 Wood
4,533,047 A 8/1985 Calvert
4,601,390 A 7/1986 Rosenthal et al.
4,708,284 A 11/1987 Sutherland et al.
4,722,437 A 2/1988 Walsh
4,792,038 A 12/1988 Cooper
4,927,009 A 5/1990 Stout
5,040,672 A 8/1991 DeMaio et al.
5,069,335 A * 12/1991 Beales ..... B65D 71/0007 206/190
5,167,325 A 12/1992 Skora
5,221,001 A * 6/1993 Eisman ..... B65D 71/0077 206/190
5,234,103 A 8/1993 Schuster
5,392,984 A 2/1995 Yocum
5,437,363 A 8/1995 Gungner
5,458,234 A 10/1995 Harris
5,484,053 A 1/1996 Harris
5,485,915 A 1/1996 Harris
5,499,712 A 3/1996 Harrelson
5,531,319 A 7/1996 Harrelson
5,538,130 A 7/1996 Harrelson
5,538,131 A 7/1996 Harrelson
5,549,197 A 8/1996 Sutherland
5,590,762 A 1/1997 Harrelson
5,590,776 A 1/1997 Galbierz
5,593,027 A 1/1997 Sutherland
5,595,291 A 1/1997 Negelen
5,624,024 A 4/1997 Miess
5,649,620 A 7/1997 Harrelson
5,657,864 A 8/1997 Harrelson
5,657,865 A 8/1997 Harrelson
5,682,982 A 11/1997 Stonehouse
5,695,051 A 12/1997 Hart
5,775,487 A 7/1998 Harrelson
5,775,574 A 7/1998 Whitnell
5,791,462 A * 8/1998 Whitnell ..... B65D 71/0022 206/504
5,803,264 A 9/1998 Gersten et al.
5,871,090 A 2/1999 Doucette et al.
5,878,877 A 3/1999 Sutherland
5,947,273 A 9/1999 Dalrymple et al.
5,979,747 A 11/1999 Gnadt et al.
6,024,212 A * 2/2000 Whitnell ..... B65D 71/0014 206/185
6,089,638 A * 7/2000 Whitnell ..... B65D 71/0014 206/175
6,131,729 A 10/2000 Eckermann et al.
6,155,962 A 12/2000 Dalrymple et al.
6,230,882 B1 5/2001 Wischusen, III
6,315,111 B1 11/2001 Sutherland
6,341,689 B1 1/2002 Jones
6,371,287 B1 4/2002 Jones et al.
6,598,739 B1 7/2003 Collura
6,695,137 B2 2/2004 Jones et al.
6,736,260 B2 5/2004 Gomes et al.
6,866,187 B2 3/2005 Reagan
6,896,130 B2 5/2005 Theelen
6,938,756 B2 9/2005 Schuster
7,011,209 B2 3/2006 Sutherland et al.
7,134,547 B2 11/2006 Auclair
D538,644 S 3/2007 DeVine
7,185,758 B2 3/2007 Cuomo
7,243,785 B2 7/2007 Cuomo
7,267,224 B2 9/2007 Cuomo
7,357,247 B2 4/2008 Guenther
7,370,755 B2 5/2008 Cuomo
7,374,038 B2 5/2008 Smalley
7,578,385 B2 8/2009 Holley, Jr.
7,604,115 B2 10/2009 Cuomo
7,677,387 B2 3/2010 Brand et al.
7,753,196 B2 * 7/2010 Cuomo ..... B65D 71/0014 206/175
8,091,702 B1 * 1/2012 Keip ..... B65D 71/0037 206/175
8,424,677 B2 4/2013 Spivey, Sr. et al.
D698,267 S 1/2014 Wagner
8,622,207 B2 1/2014 Smalley
D729,073 S 5/2015 Wasilewski
10,287,073 B2 * 5/2019 Zammit ..... B65B 43/265
D875,550 S 2/2020 Hong
D878,932 S 3/2020 Holley, Jr.
D881,011 S * 4/2020 Wolf ..... D9/737
D944,655 S 3/2022 Rattanapaiboonchaoren

(56) References Cited

U.S. PATENT DOCUMENTS

| | | | |
|---|---|---|---|
| 2002/0020653 | A1 | 2/2002 | Davis |
| 2003/0111363 | A1 | 6/2003 | Theelen |
| 2003/0159950 | A1 | 8/2003 | Jones et al. |
| 2003/0213705 | A1 | 11/2003 | Woog |
| 2004/0094435 | A1 | 5/2004 | Auclair et al. |
| 2005/0103651 | A1 | 5/2005 | Lebras |
| 2005/0230273 | A1 | 10/2005 | Kohler |
| 2007/0029212 | A1 | 2/2007 | Smalley |
| 2009/0008273 | A1 | 1/2009 | Smalley |
| 2010/0252456 | A1 | 10/2010 | Cook et al. |
| 2016/0236840 | A1 | 8/2016 | Schindler |
| 2017/0144814 | A1 | 5/2017 | Schindler |
| 2017/0152091 | A1 | 6/2017 | Holley, Jr. |
| 2021/0371178 | A1 | 12/2021 | Gungner |

FOREIGN PATENT DOCUMENTS

| | | | | | |
|---|---|---|---|---|---|
| CN | 101484368 | A | | 7/2009 | |
| CN | 101484368 | A | * | 7/2009 | ..... B65D 71/0022 |
| DE | 9004439 | | | 6/1990 | |
| EP | 0 452 563 | | | 10/1991 | |
| EP | 1 319 607 | | | 6/2003 | |
| EP | 1 348 638 | | | 10/2003 | |
| FR | 1 447 208 | | | 7/1966 | |
| GB | 2 279 065 | | | 12/1994 | |
| GB | 6113287 | | | 1/2021 | |
| KR | 200305808 | Y1 | * | 3/2003 | ..... B65D 71/0014 |
| KR | 101656733 | B1 | * | 9/2016 | ..... B65D 5/04 |
| WO | WO 97/05026 | | | 2/1997 | |
| WO | WO 98/19932 | | | 5/1998 | |
| WO | WO 2005/044687 | | | 5/2005 | |
| WO | WO 2010/036778 | A1 | | 4/2010 | |
| WO | WO 2017/091375 | A1 | | 6/2017 | |

* cited by examiner

CARRIER WITH CONTAINER RETENTION FEATURES

CROSS-REFERENCE TO RELATED APPLICATION

This application claims the benefit of U.S. Provisional Patent Application No. 63/031,764, filed on May 29, 2020.

INCORPORATION BY REFERENCE

The disclosure of U.S. Provisional Patent Application No. 63/031,764, filed on May 29, 2020, is hereby incorporated by reference for all purposes as if presented herein in its entirety.

BACKGROUND OF THE DISCLOSURE

The present disclosure generally relates to carriers for holding articles therein. In particular, the present disclosure is directed to a carrier having a central panel or partition with container retention features for stabilizing containers disposed in the carrier.

SUMMARY OF THE DISCLOSURE

According to one aspect, the disclosure is generally directed to a carrier for holding at least one container, the carrier comprising a plurality of panels extending at least partially around an interior of the carrier, the plurality of panels comprising a front panel, a back panel, at least one side panel, and at least one handle panel extending between the front panel and the back panel. The carrier further comprises container retaining features for stabilizing the at least one container in the interior of the carrier, the container retaining features comprising at least one container retention cut formed in an upper portion of at least one of the front panel and the back panel.

According to another aspect, the disclosure is generally directed to a blank for forming a carrier for holding at least one container, the blank comprising a plurality of panels extending for at least partially around an interior of the carrier formed from the blank, the plurality of panels comprising a front panel, a back panel, at least one side panel, and at least one handle panel. The blank further comprises container retaining features for stabilizing the at least one container in the interior of the carrier formed from the blank, the container retaining features comprising at least one container retention cut formed in an upper portion of at least one of the front panel and the back panel.

According to another aspect, the disclosure is generally directed to a method of forming a carrier for holding at least one container, the method comprising obtaining a blank comprising a plurality of panels comprising a front panel, a back panel, at least one side panel, and at least one handle panel, and container retaining features comprising at least one container retention cut formed in an upper portion of at least one of the front panel and the back panel. The method further comprises folding the plurality of panels at least partially around an interior of the container such that the handle panel extends between the front panel and the back panel.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts may be designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., paperboard and/or polymeric cups) at least partially disposed within the carrier embodiments. In this specification, the terms "lower," "bottom," "upper," "top," "front," and "back" indicate orientations determined in relation to fully erected carriers.

As described herein, carriers can be formed by multiple overlapping portions, panels, and/or end flaps. Such portions, panels, and/or end flaps can be designated in relative terms to one another, e.g., "first", "second", "third", etc., in sequential or non-sequential reference, without departing from the disclosure.

Figure 1:
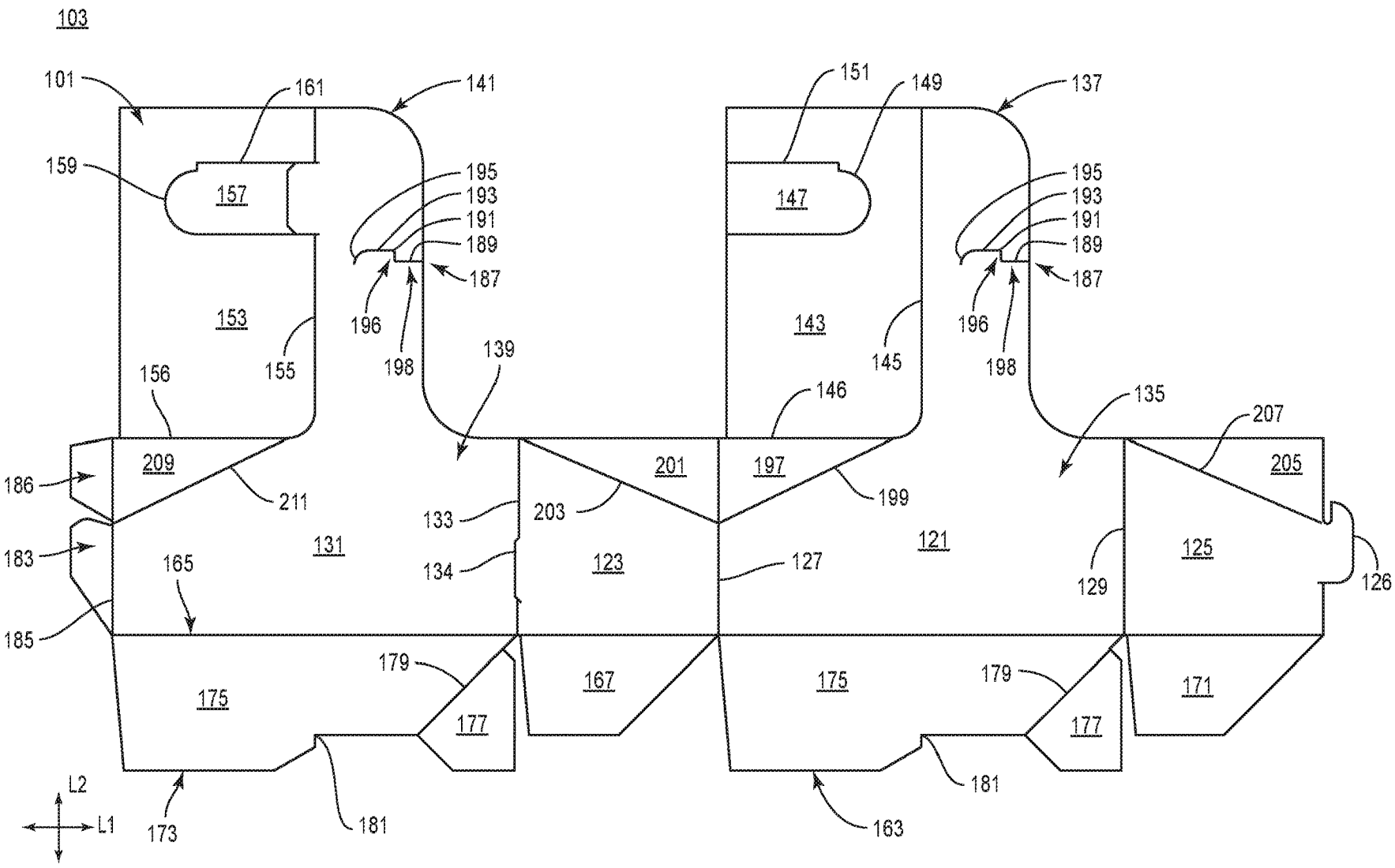
FIG. 1 is a plan view of an exterior surface of a blank for forming a carrier according to an exemplary embodiment of the disclosure.

FIG. 1 is a plan view of the exterior side 101 of a blank, generally indicated at 103, that can be obtained and used to form a carton or carrier 105 (FIG. 2) according to one exemplary embodiment of the disclosure.

As described herein, the blank 103/carrier 105 can include container retention features for engaging and stabilizing one or more containers supported in the carrier 105, e.g., to minimize, inhibit, avoid, and/or prevent unwanted tipping of the containers and/or spillage of beverage contents therein.

As shown in FIG. 1, the blank 103 has a longitudinal axis L1 and a lateral axis L2. The blank 103 comprises a front panel 121 foldably connected to a first side panel 123 and a second side panel 125 at respective lateral fold lines 127, 129. A back panel 131 is foldably connected to the first side panel 123 at a lateral fold line 133.

The front panel 121, as shown, can include a first or lower potion 135 and a second or upper portion 137 extending upwardly from the lower portion 135. Similarly, the back panel 131 can include a first or lower portion 139 and a second or upper portion 141 extending upwardly from the lower portion 139.

In the illustrated embodiment, the second side panel 125 can define a securing tab 126 protruding therefrom, and which can have a configuration corresponding to a cut or slot 134 that interrupts the lateral fold line 133, as described further herein.

The blank 103 can also include a first handle panel 143 foldably connected to the upper portion 137 of the front panel 121 at a lateral fold line 145, and which is separated from the lower portion 135 of the front panel 121 at a longitudinal cut 146. As shown, the cut 146 can have a curved portion or other region of transition that intersects the fold line 145. A handle reinforcement flap 147 can be defined by an at least partially curved cut 149 and can be foldably connected to the handle panel 143 at a longitudinal fold line 151.

Similarly, a second handle panel 153 can be foldably connected to the upper portion 141 of the back panel 131 at a lateral fold line 155, and can be separable from the lower portion 139 of the back panel 131 at a longitudinal cut 156 that can have a curved portion or other region of transition that intersects the fold line 155. A handle reinforcement flap 157 can be defined by a cut 159 and foldably connected to the handle panel 153 at a longitudinal fold line 161.

As described herein, the handle panels 143, 153 and the handle reinforcement flaps 147, 157 can be handle features for forming a handle 109 (FIG. 2) of the carrier 105.

Still referring to FIG. 1, the blank 103 can include a plurality of end flaps foldably connected to respective panels of the plurality of panels. As shown, a front bottom end flap 163 can be foldably connected to the front panel 123 at a respective portion of a longitudinal fold line 165, a first side bottom end flap 167 can be foldably connected to the first side panel 123 at a respective portion of the fold line 165, a second side bottom end flap 171 can be foldably connected to the second side panel 125 at a respective portion of the fold line 165, and a back bottom end flap 173 can be foldably connected to the back panel 131 at a respective portion of the fold line 165.

The front bottom end flap 163 can include a base portion 175 foldably connected to the front panel 121 at the respective portion of the fold line 165, and a distal portion 177 foldably connected to the base portion 175 at an oblique fold line 179. The base portion 175 of the end flap 163 can define a shoulder/notch 181 or other recessed portion therealong.

Similarly, the back bottom end flap 173 can include a base portion 175 foldably connected to the back panel 131 at the respective portion of the fold line 165, a distal portion 177 foldably connected to the base portion 175 at an oblique fold line 179, and a shoulder/notch 181 formed along the base portion 175.

With continued reference to FIG. 1, an attachment flap 183 can be foldably connected to a free edge of the back panel 131 at a respective portion of a lateral fold line 185, and an attachment flap 186 can be foldably connected to a container retention flap 209 at a respective portion of the fold line 185.

As described herein, the blank 103/carrier 105 can include container retention features for engaging/stabilizing one or more containers supported in the carrier 105. As shown, a container retention cut 187 can be formed in the upper portion 137 of the front panel 121, and can include a first longitudinal cut section 189 extending from a free edge of the upper portion 137 to an endpoint of a vertical cut section 191, the vertical cut section 191 extending to an endpoint of a second longitudinal cut section 193 that intersects a curved cut section 195. In this regard, the container retention cuts 187 forms a shoulder or notch 196 adjacent a protruding portion 198 of the upper portion 137 of the front panel 121 when the upper portion 137 of the front panel 121 is at least partially separated from the remainder of the front panel 121, as described further herein. It will be understood that the container retention cut 187 can have a different configuration without departing from the disclosure.

With continued reference to FIG. 1, container retention features of the blank 103 can include a container retention flap 197 foldably connected to the front panel 121 at an oblique fold line 199. A container retention flap 201 can also be foldably connected to the first side panel 123 at an oblique fold line 203 that intersects the oblique fold line 199 and the lateral fold line 127. As shown, the container retention flap 197 can be foldably connected to the container retention flap 201 at a portion of the fold line 127.

A container retention flap 205 can also be foldably connected to the second side panel 125 at an oblique fold line 207, and a container retention flap 209 can be foldably connected to the back panel 131 at an oblique fold line 211.

Any of the panels, flaps, fold lines, cuts, or other features could be otherwise shaped, arranged, and/or omitted from the blank 103 without departing from the disclosure. The blank 103 could be differently sized and/or shaped, for example, to accommodate a different number or arrangement of containers, without departing from this disclosure.

Figure 2:
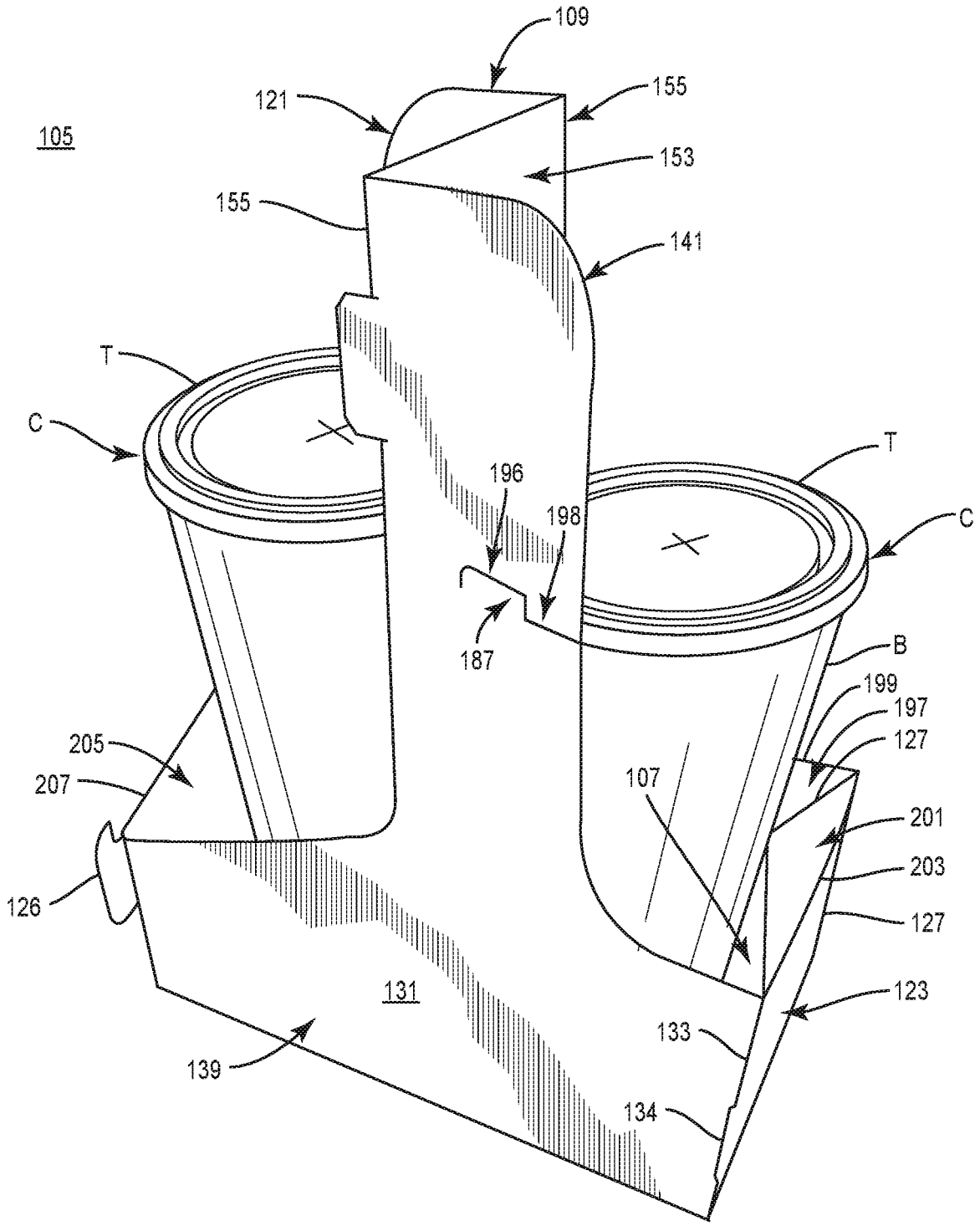
FIG. 2 is a perspective view of a carrier formed from the blank of FIG. 1 according to an exemplary embodiment of the disclosure.

Referring to FIG. 2, the carrier 105 formed from the blank 103 is illustrated according to one exemplary embodiment of the disclosure. In one embodiment, the blank 103 can be positioned with the exterior surface 101 facing downwardly on a supporting surface, and with the interior surface of the blank 103 facing upwardly.

The bottom end flaps 163, 167, 171, 173 can be folded upwardly at the respective portions of the fold line 165 into at least partial face-to-face contact with respective portions of the panels 121, 123, 125, 131. The distal portion 177 of the bottom end flap 163 can be folded at the fold line 179 into at least partial face-to-face contact with the base portion 175 of the bottom end flap 163. Similarly, the distal portion 177 of the bottom end flap 173 can be folded at the fold line 179 into at least partial face-to-face contact with the base portion 175 of the bottom end flap 173.

Thereafter, the back panel 131 can be folded at the fold line 133 into at least partial face-to-face contact with respective portions of the first side panel 123 and the front panel 121, and such that the attachment flaps 183, 186 are positioned in at least partial face-to-face contact with the front panel 121. During such folding, the handle panel 153 can also be carried into partial face-to-face contact with a portion of the handle panel 143 such that the handle reinforcement flaps 147, 157 are positioned in alignment. In addition, the second side panel 125 can be folded at the fold line 129 into at least partial face-to-face contact with the attachment flaps 183, 186.

The aforementioned arrangement of panels, flaps, and other features of the blank 103 can be maintained with an adhesive such as glue. In this regard, a folded/collapsed configuration of the carrier 105 can be provided.

The carrier 105 can be further erected by arranging the front panel 121 and the back panel 131 in parallel spaced relation, with the first side panel 123 and the second side panel 125 arranged in parallel spaced relation, and such that the panels 121, 123, 125, 131 extend at least partially around an interior 107 of the carrier 105.

Such movement of the panels 121, 123, 125, 131 can cause the overlapping handle panels 143, 153 to separate from the respective front panel 121 and back panel 131 at the respective cuts 146, 156 and to fold relative to the respective upper portions 137, 141 thereof at the respective fold lines 145, 155. In this regard, the overlapping handle panels 143, 153 can extend between the front panel 121 to the back panel 131 and with the handle reinforcement flaps 147, 157 aligned, e.g., vertically, such that a handle 109 of the carrier 105 is provided.

In addition, the aforementioned movement of the panels 121, 123, 125, 131 can cause the bottom end flaps 163, 167, 171, 173 to fold downwardly at respective portions of the fold line 165 to form a closed bottom of the carrier 105. The end flaps 163, 167, 171, 173 can be positioned in at least partial overlapping arrangement, with the distal portion 177 of the end flap 163 in at least partial face-to-face contact with the end flap 171, the distal portion 177 of the end flap 173 in at least partial face-to-face contact with the end flap 167, and the notches 181 of the respective end flaps 163, 173 in at least partial edge-to-edge/face-to-face/interfering engagement.

Figure 3:
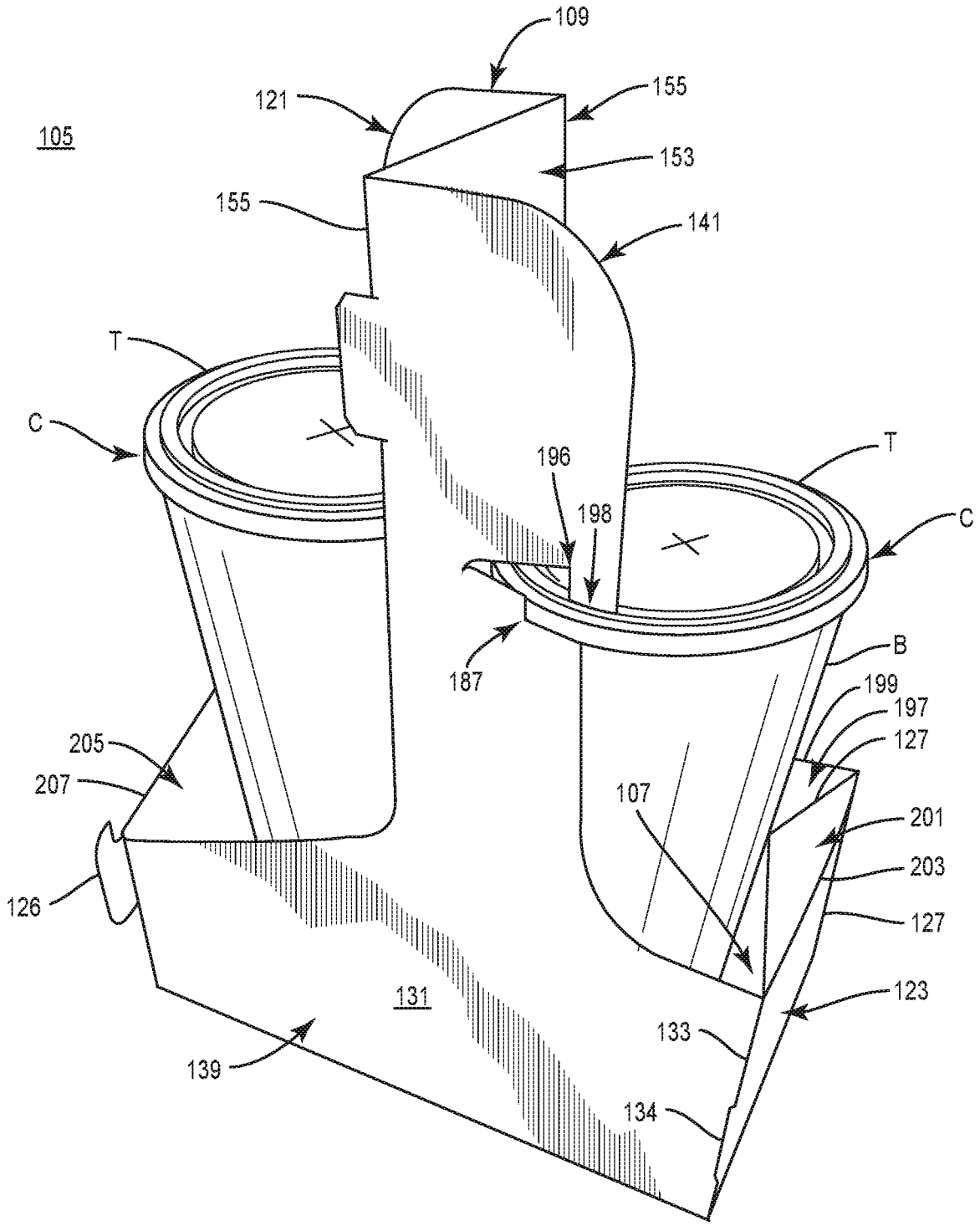
FIG. 3 is a perspective view of the carrier of FIG. 2, with container retention features activated.
Figure 4:
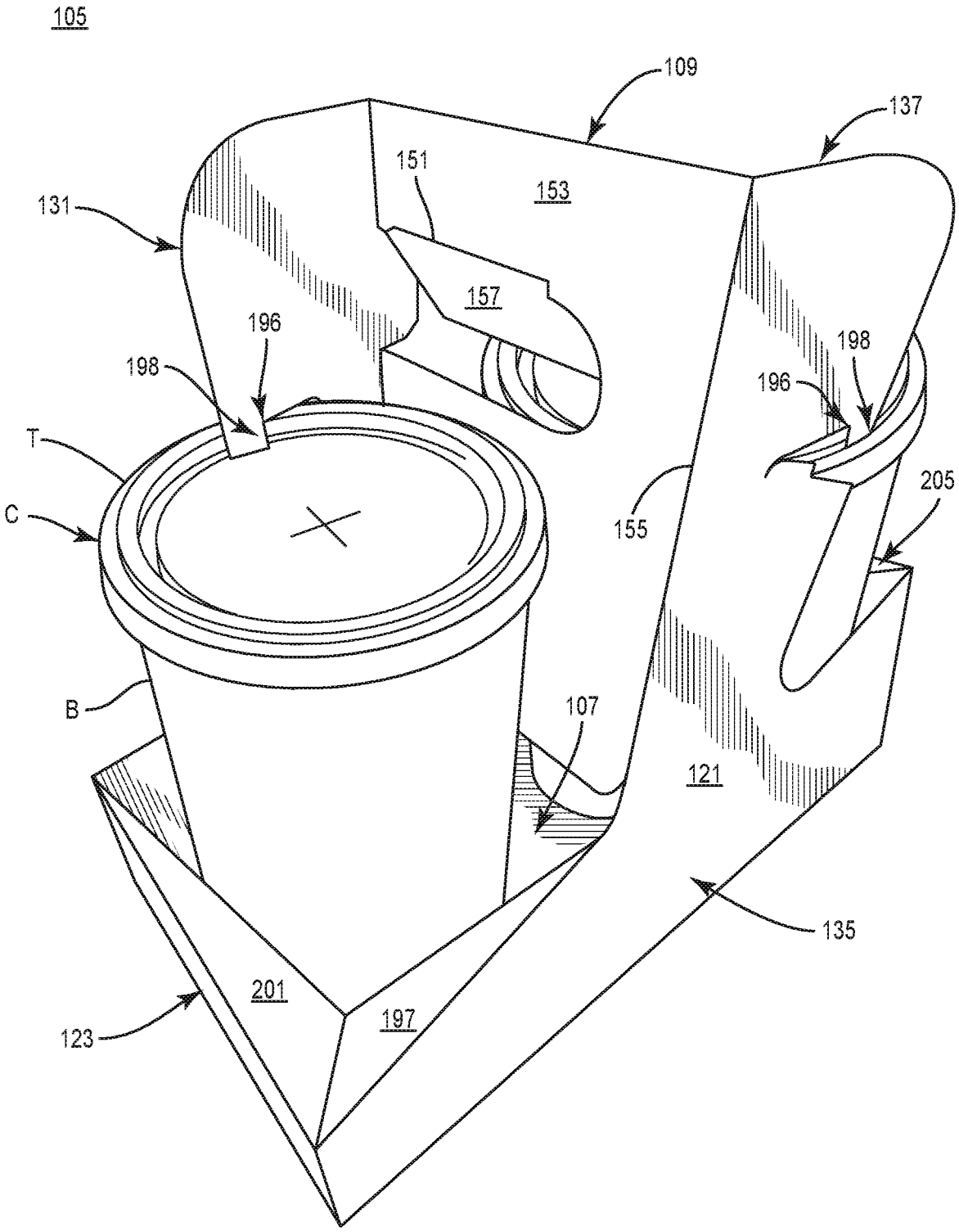
FIG. 4 is another perspective view of the carrier of FIG. 2 with the container retention features activated.

As shown in FIGS. 3 and 4, containers C can be at least partially inserted into the interior 107 of the carrier 105, and with upper portions thereof maintained in at least partial separation by the handle panels 143, 153 extending from the front panel 121 to the back panel 131. While the carrier 105 is illustrated as accommodating two side-by-side containers C, it will be understood that a different number and/or arrangement of containers can be provided.

The containers C, as shown, can be beverage containers having a cup or body portion B and a lid portion or lid T engaged with the body portion B. In one embodiment, the body portion B can be a paperboard construct having a bottom and at least one sidewall to define an interior for receiving one or more beverages, and the lid T can be a polymeric member that mechanically engages a rolled rim or upper edge of the body portion B. The containers C can be provided to hold hot or warm fluids (e.g., tea, coffee, hot chocolate, cider, etc.), or cold fluids (soft drinks, iced drinks, ice cream, confectionary beverages, etc.).

As shown, insertion of the containers C into the interior 107 of the carrier 105 can cause the container retention flaps 197, 201, 205, 209 to fold downwardly at the respective fold lines 199, 203, 207, 211 toward the interior 107 of the carrier 105. In one embodiment, one or more of the container retention flaps 197, 201, 205, 209 can be folded manually or by a machine part, for example, upon erection of the carrier 105 and/or prior to insertion of the containers C into the carrier 105.

As shown, the container retention flaps 197, 201, 205, 209 can be positioned to extend away from the respective panels 121, 123, 125, 131 to engage the body portion B of the respective containers C at respective edge or surface portions thereof. In this regard, the containers retention flaps 197, 201, 205, 209 can be provided to engage the containers C such that movement of the containers C within the interior 107 of the carrier 105 is restricted/minimized/inhibited/prevented, e.g., so as to stabilize the containers C during movement/carrying of the carrier 105 to avoid unwanted tipping or the containers C and/or spillage of beverage contents held in the containers C.

Furthermore, since the container retention flaps 197, 201, 205, 209 are movable relative to the respective panels 121, 123, 125, 131, a carrier 105 with an interior 107 of a predetermined size can be provided, and the container retention flaps 197, 201, 205, 209 can be at least partially reconfigurable so as to move in the presence of differently-sized containers C so as to accommodate and stabilize a variety of different containers C.

In the aforementioned arrangement, adjacent container retention flaps can be positioned to intersect/abut/lie closely adjacent one another, e.g., with the container retention flap 205 adjacent the container retention flap 209, and with the container retention flap 197 adjacent the container retention flap 201. In accordance with the discussion above, such adjacent container retention flaps are also movable relative to one another.

As also shown, the upper portions 137, 141 of the respective front panel 121 and back panel 131 are separable/movable relative to the remainder of the respective front panel 121 and back panel 131 so as to be positioned such that the edges thereof defined by the respective cuts 187 are positioned to engage the lids T of the respective containers C. For example, the upper portions 137, 141 of the respective front panel 121 and back panel 131 can be flexed, bent, twisted, bowed, etc., such that the notches 196 of the respective upper portions 137, 141 can rest against/engage a raised rim or other protrusion of the respective lids T, with the protruding portion 198 of the respective upper portions 137, 141 extending into a recessed portion of the respective lids T. In this regard, the lids T or other portions of the containers C can cam over the edges of the respective panels 121, 131 defined by the respective cuts 187.

The geometry of the respective cuts 187, e.g., the intersection of the respective cut sections 189, 191, 193, 195 can provide edges of variable geometry along the respective cuts 187 at which the respective upper portions 137, 141 of the respective front panel 121 and back panel 131 can engage features of the respective lids T. In one embodiment, one or both of the respective upper portions 137, 141 can engage a protruding peripheral rim portion of the respective lids T. In another embodiment, the upper portions 137, 141 can be configured to directly engage the body portion of a container, for example a rim or upper edge of a container, without any lid present.

In use, a user or customer can grasp the carrier 105 at the handle 109 to lift and/or carry the carrier 105. In one embodiment, the user/customer can separate the handle reinforcement flaps 147, 157 from the respective handle panels 143, 153 at the respective cuts 149, 159 and fold the handle reinforcement flaps 147, 157 at the respective fold lines 151, 161, for example, to provide a handle opening through which a user/operator can insert one or more of his or her fingers to grasp the handle 109. In addition, the handle reinforcement flaps 147, 157 can provide additional layers of material that can be overlapped with the handle panels 143, 153 to provide additional strength and resistance to tearing of the handle 109 during lifting/carrying of the carrier 105.

In view of the foregoing, the blank 103/carrier 105 can be provided with container retention features, e.g., one or more of the cuts 187/associated features and/or the container retention flaps 197, 201, 205, 209, to engage and stabilize one or more containers C supported in the carrier 105, e.g., to minimize, inhibit, and/or prevent unwanted tipping of the containers and/or spillage of beverage contents therein.

Figure 5:
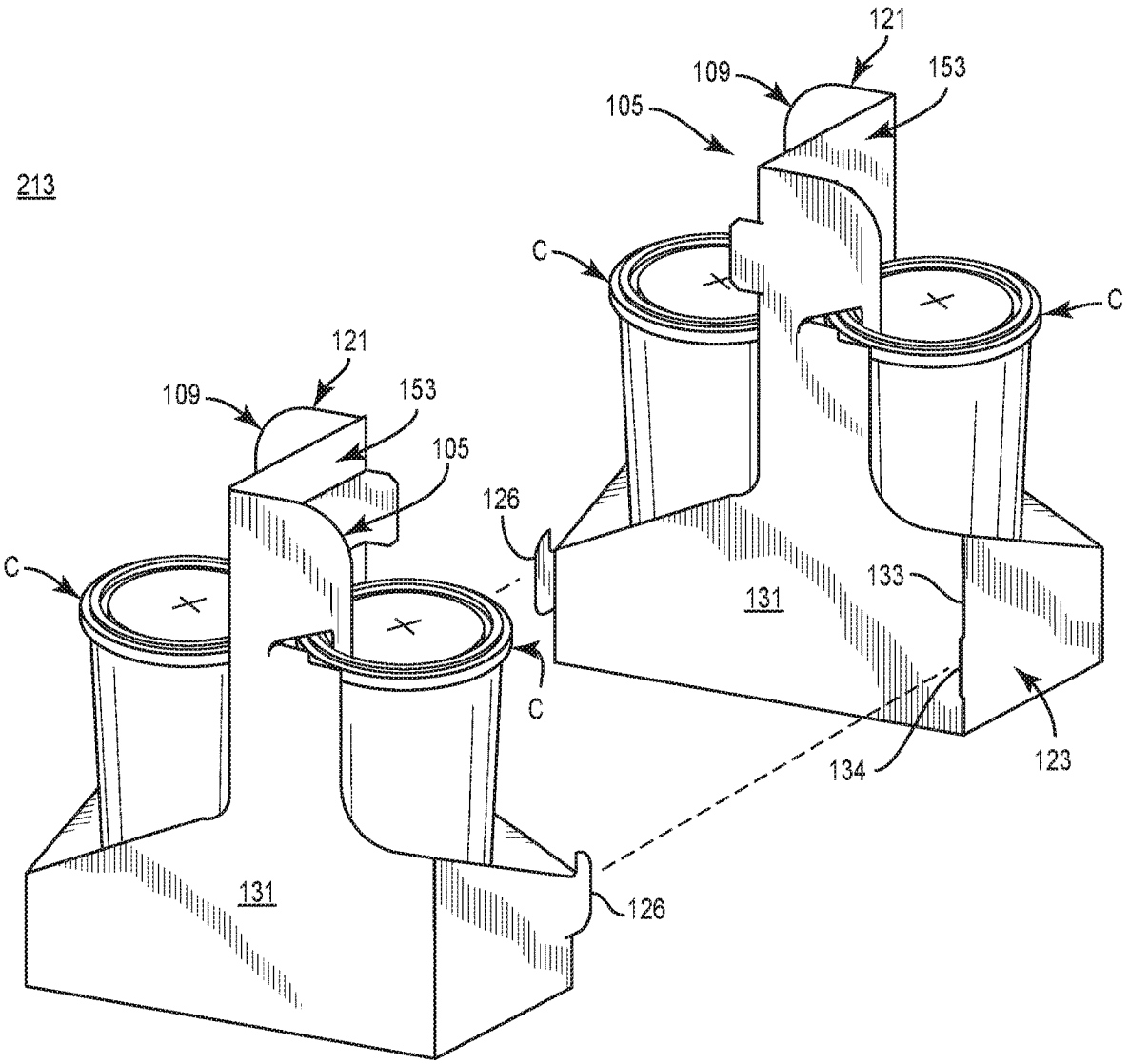
FIG. 5 is a perspective view of a package formed from a pair of carriers having the configuration of the carrier of FIG. 2 according to an exemplary embodiment of the disclosure.

Referring additionally to FIG. 5, a plurality of carriers 105 can be provided and attached to one another to form a package 213. In one embodiment, the securing tab 126 of a first carrier can be at least partially inserted into the slot 134 of a second carrier 105 to attach/couple the carriers 105 and provide the package 213. In this regard, the securing tab 126 can be provided with a geometry that provides secure coupling to avoid unwanted disengagement of the carriers 105, for example, hooks, barbs, notches, protrusions, etc. Clearance for the securing tab 126 of the first carrier 105 to enter the slot 134 of the second carrier 105 can be provided by the spacing of the container C from the panels 123, 131 in the second carrier 105 due to the engagement of the container retention flaps 201, 209 with the container C.

In this regard, multiple carriers 105 can be coupled as a package 213, and, in one embodiment, can be carried together by engagement of one or both respective handles 109 of the carriers 105 by a user/operator. While the package 213 is illustrated as including two carriers 105, it will be understood that more than two carriers 105 can be coupled in the manner described above to provide a differently-configured package.

Any of the features of the various embodiments of the disclosure can be combined with, replaced by, or otherwise configured with other features of other embodiments of the disclosure without departing from the scope of this disclosure. Further, the panels, flaps, and/or other features shown and described in conjunction with the blanks could be otherwise shaped, arranged, and/or configured without departing from the disclosure.

The carriers according to the present disclosure can be, for example, formed from blanks of coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carrier to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels, flaps, or features, adhered together by glue during erection of the carrier embodiments. The term "glue" is intended to encompass all manner of adhesives commonly used to secure carrier panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding at least one container, the carrier comprising:

a plurality of panels extending at least partially around an interior of the carrier, the plurality of panels comprising a front panel, a back panel, at least one side panel, and at least one handle panel extending between the front panel and the back panel; and container retaining features for stabilizing the at least one container in the interior of the carrier, the container retaining features comprising at least one container retention cut formed in an upper portion of at least one of the front panel and the back panel such that the upper portion of the at least one of the front panel and the back panel is at least partially separable from a lower portion of the at least one of the front panel and the back panel, the at least one container retention cut forming a protruding portion of the at least one of the front panel and the back panel, the protruding portion being positionable in engagement with a lid of the at least one container.

2. The carrier of claim 1, wherein the upper portion of the at least one of the front panel and the back panel is moveable relative to the remainder of the at least one of the front panel and the back panel at the at least one container retention cut.

3. The carrier of claim 2, wherein the at least one container retention cut forms a notch adjacent the protruding portion of the upper portion of the at least one of the front panel and the back panel.

4. The carrier of claim 3, wherein the notch and the protruding portion of the upper portion of the at least one of the front panel and the back panel are configured for engaging at least one container in the carrier when the upper portion of the at least one of the front panel and the back panel is moved relative to the remainder of the at least one of the front panel and the back panel at the at least one container retention cut.

5. The carrier of claim 4, wherein the at least one container retention cut is a container retention cut formed in an upper portion of the front panel, and the container retention features further comprise a container retention cut formed in an upper portion of the back panel.

6. The carrier of claim 1, wherein the container retaining features further comprises a plurality of container retention flaps foldably connected to respective panels of the plurality of panels and extending into the interior of the carrier.

7. The carrier of claim 6, wherein the plurality of container retention flaps comprises a container retention flap foldably connected to the front panel, a container retention flap foldably connected to the back panel, and a container retention flap foldably connected to the at least one side panel.

8. The carrier of claim 7, wherein the container retention flap foldably connected to the at least one side panel is positioned to intersect one of the container retention flap foldably connected to the front panel and the container retention flap foldably connected to the back panel.

9. The carrier of claim 8, wherein the at least one side panel is a first side panel and the plurality of panels further comprises a second side panel, the container retention flap foldably connected to the at least one side panel is a container retention flap foldably connected to the first side panel, and the plurality of container retention flaps further comprises a container retention flap foldably connected to the second side panel.

10. The carrier of claim 9, wherein the container retention flap foldably connected to the front panel is foldably connected to the container retention flap foldably connected to the first side panel.

11. The carrier of claim 10, wherein adjacent container retention flaps of the container retention flaps are movable relative to one another.

12. The carrier of claim 3, wherein the at least one handle panel is foldably connected to one of the front panel and the back panel.

13. The carrier of claim 12, wherein the at least one handle panel is a first handle panel foldably connected to the front panel, and the plurality of panels further comprises a second handle panel foldably connected to the back panel, the first handle panel is in at least partial face-to-face contact with the second handle panel.

14. The carrier of claim 3, wherein the at least one side panel is a first side panel and the plurality of panels further comprises a second side panel, one of the first side panel and the second side panel comprising a securing tab protruding therefrom, the other of the first side panel and the second side panel adjacent a slot configured for at least partially receiving a securing tab of another carrier.

15. A blank for forming a carrier for holding at least one container, the blank comprising:

a plurality of panels extending for at least partially around an interior of the carrier formed from the blank, the plurality of panels comprising a front panel, a back panel, at least one side panel, and at least one handle panel;

container retaining features for stabilizing the at least one container in the interior of the carrier formed from the blank, the container retaining features comprising at least one container retention cut formed in an upper portion of at least one of the front panel and the back panel such that the upper portion of the at least one of the front panel and the back panel is at least partially separable from a lower portion of the at least one of the front panel and the back panel, the at least one container retention cut forming a protruding portion of the at least one of the front panel and the back panel, the protruding portion being positionable in engagement with a lid of the at least one container.

16. The blank of claim 15, wherein the upper portion of the at least one of the front panel and the back panel is moveable relative to the remainder of the at least one of the front panel and the back panel at the at least one container retention cut.

17. The blank of claim 16, wherein the at least one container retention cut forms a notch adjacent the protruding portion of the upper portion of the at least one of the front panel and the back panel.

18. The blank of claim 17, wherein the notch and the protruding portion of the upper portion of the at least one of the front panel and the back panel are configured for engaging at least one container in the carrier formed from the blank when the upper portion of the at least one of the front panel and the back panel is moved relative to the remainder of the at least one of the front panel and the back panel at the at least one container retention cut.

19. The blank of claim 18, wherein the at least one container retention cut is a container retention cut formed in an upper portion of the front panel, and the container retention features further comprise a container retention cut formed in an upper portion of the back panel.

20. The blank of claim 15, wherein the container retaining features further comprise a plurality of container retention flaps foldably connected to respective panels of the plurality of panels for extending into the interior of the carrier formed from the blank.

21. The blank of claim 20, wherein the plurality of container retention flaps comprises a container retention flap foldably connected to the front panel, a container retention flap foldably connected to the back panel, and a container retention flap foldably connected to the at least one side panel.

22. The blank of claim 21, wherein the at least one side panel is a first side panel and the plurality of panels further comprises a second side panel, the container retention flap foldably connected to the at least one side panel is a container retention flap foldably connected to the first side panel, and the plurality of container retention flaps further comprises a container retention flap foldably connected to the second side panel.

23. The blank of claim 22, wherein the container retention flap foldably connected to the front panel is foldably connected to the container retention flap foldably connected to the first side panel.

24. The blank of claim 23, wherein adjacent container retention flaps of the container retention flaps are movable relative to one another.

25. The blank of claim 17, wherein the at least one handle panel is foldably connected to one of the front panel and the back panel.

26. The blank of claim 25, wherein the at least one handle panel is a first handle panel foldably connected to the front panel, and the plurality of panels further comprises a second handle panel foldably connected to the back panel, the first handle panel is for being positioned in at least partial face-to-face contact with the second handle panel when the carrier is formed from the blank.

27. The blank of claim 17, wherein the at least one side panel is a first side panel and the plurality of panels further comprises a second side panel, one of the first side panel and the second side panel comprising a securing tab protruding therefrom, the other of the first side panel and the second side panel adjacent a slot configured for at least partially receiving a securing tab of another carrier.

28. A method of forming a carrier for holding at least one container, the method comprising:

obtaining a blank comprising a plurality of panels comprising a front panel, a back panel, at least one side panel, and at least one handle panel, and container retaining features comprising at least one container retention cut formed in an upper portion of at least one of the front panel and the back panel such that the upper portion of the at least one of the front panel and the back panel is at least partially separable from a lower portion of the at least one of the front panel and the back panel, the at least one container retention cut forming a protruding portion of the at least one of the front panel and the back panel; and folding the plurality of panels at least partially around an interior of the container such that the handle panel extends between the front panel and the back panel and such that the protruding portion is positionable in engagement with a lid of the at least one container.

29. The method of claim 28, further comprising moving the upper portion of the at least one of the front panel and the back panel relative to the remainder of the at least one of the front panel and the back panel at the at least one container retention cut.

30. The method of claim 29, wherein the at least one container retention cut forms a notch adjacent a protruding portion of the upper portion of the at least one of the front panel and the back panel.

31. The method of claim 30, further comprising engaging at least one container in the carrier with the notch and the protruding portion of the upper portion of the at least one of the front panel and the back panel when the upper portion of the at least one of the front panel and the back panel is moved relative to the remainder of the at least one of the front panel and the back panel at the at least one container retention cut.

32. The method of claim 31, wherein the at least one container retention cut is a container retention cut formed in an upper portion of the front panel, and the container retention features further comprise a container retention cut formed in an upper portion of the back panel.

33. The method of claim 28, wherein the container retaining features further comprises a plurality of container retention flaps foldably connected to respective panels of the plurality of panels, and the method further comprises folding the plurality of container retention flaps such that the plurality of container retention flaps extends into the interior of the carrier.

34. The method of claim 33, wherein the plurality of container retention flaps comprises a container retention flap foldably connected to the front panel, a container retention flap foldably connected to the back panel, and a container retention flap foldably connected to the at least one side panel.

35. The method of claim 34, wherein the container retention flap foldably connected to the at least one side panel is positioned to intersect one of the container retention flap foldably connected to the front panel and the container retention flap foldably connected to the back panel.

36. The method of claim 35, wherein the at least one side panel is a first side panel and the plurality of panels further comprises a second side panel, the container retention flap foldably connected to the at least one side panel is a container retention flap foldably connected to the first side panel, and the plurality of container retention flaps further comprises a container retention flap foldably connected to the second side panel.

37. The method of claim 36, wherein the container retention flap foldably connected to the front panel is foldably connected to the container retention flap foldably connected to the first side panel.

38. The method of claim 37, wherein adjacent container retention flaps of the container retention flaps are movable relative to one another.

39. The method of claim 30, wherein the at least one handle panel is foldably connected to one of the front panel and the back panel.

40. The method of claim 39, wherein the at least one handle panel is a first handle panel foldably connected to the front panel, and the plurality of panels further comprises a second handle panel foldably connected to the back panel, the method further comprises positioning the first handle panel is in at least partial face-to-face contact with the second handle panel.

41. The method of claim 30, wherein the at least one side panel is a first side panel and the plurality of panels further comprises a second side panel, one of the first side panel and the second side panel comprising a securing tab protruding therefrom, the other of the first side panel and the second side panel adjacent a slot configured for at least partially receiving a securing tab of another carrier.

42. The method of claim 41, further comprising receiving the securing tab of another carrier in the slot.

* * * * *